US010118393B2

(12) United States Patent
Yoshikawa et al.

(10) Patent No.: US 10,118,393 B2
(45) Date of Patent: Nov. 6, 2018

(54) PRINTING APPARATUS, PRINTING METHOD, AND NON-TRANSITORY COMPUTER-READABLE STORAGE MEDIUM

(71) Applicant: CANON KABUSHIKI KAISHA, Tokyo (JP)

(72) Inventors: Hirokazu Yoshikawa, Yokohama (JP); Yuji Hamasaki, Kawasaki (JP); Monta Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 15/334,177

(22) Filed: Oct. 25, 2016

(65) Prior Publication Data

US 2017/0120598 A1 May 4, 2017

(30) Foreign Application Priority Data

Oct. 30, 2015 (JP) ..... 2015-214963

(51) Int. Cl.

| | |
|---|---|
| ***B41J 2/165*** | (2006.01) |
| ***B41J 2/21*** | (2006.01) |
| ***B41J 2/175*** | (2006.01) |
| ***B41J 29/38*** | (2006.01) |

(52) U.S. Cl.

CPC ..... *B41J 2/16523* (2013.01); *B41J 2/16532* (2013.01); *B41J 2/1752* (2013.01); *B41J 2/1753* (2013.01); *B41J 2/17513* (2013.01); *B41J 2/17553* (2013.01); *B41J 2/2132* (2013.01); *B41J 29/38* (2013.01); *B41J 2002/16573* (2013.01)

(58) Field of Classification Search

CPC ..... B41J 2/16523; B41J 29/38; B41J 2/1753; B41J 2/1752; B41J 2/17513; B41J 2/17553; B41J 2/2132; B41J 2/16532; B41J 2002/16573; B41J 2/175; B41J 2/16517; B41J 29/393; B41J 2/2142

USPC .... 347/5, 6, 7, 9, 14, 19, 22, 23, 29, 30, 40, 347/84, 85

See application file for complete search history.

(56) References Cited

U.S. PATENT DOCUMENTS

| | | | | |
|---|---|---|---|---|
| 2007/0257956 | A1 | 11/2007 | Akase | |
| 2010/0026758 | A1* | 2/2010 | Tanaka | B41J 2/175 347/37 |
| 2012/0188304 | A1* | 7/2012 | Ibe | B41J 2/16538 347/19 |
| 2015/0022586 | A1* | 1/2015 | Yoshikawa | B41J 2/16535 347/33 |

FOREIGN PATENT DOCUMENTS

| | | | |
|---|---|---|---|
| CN | 1229031 | A | 9/1999 |
| CN | 1747838 | A | 3/2006 |
| CN | 102381025 | A | 3/2012 |
| CN | 104290451 | A | 1/2015 |
| JP | H1178068 | A | 3/1999 |
| JP | 2004058398 | A | 2/2004 |

* cited by examiner

*Primary Examiner* — Jannelle M Lebron

(74) *Attorney, Agent, or Firm* — Canon U.S.A., Inc. IP Division

(57) ABSTRACT

In various embodiments, printing is performed in a print mode with a higher ink flow rate per unit time period in a case where a time period from a time when an ink sucking operation is performed is longer, and printing is performed in a print mode with a lower ink flow rate per unit time period in a case where the time period is shorter.

20 Claims, 14 Drawing Sheets

PRINTING APPARATUS, PRINTING METHOD, AND NON-TRANSITORY COMPUTER-READABLE STORAGE MEDIUM

BACKGROUND OF THE INVENTION

Field of the Invention

The present invention relates to a printing apparatus, a printing method, and a non-transitory computer-readable storage medium.

Description of the Related Art

A printing apparatus which prints an image by performing record scanning and sub scanning repeatedly has been known. The record scanning may discharge ink by moving a print head in a scanning direction relative to a unit region on a printing medium, the print head having a discharge port array having a plurality of discharge ports. The sub scanning may convey the printing medium in a conveying direction intersecting the scanning direction.

In such a printing apparatus, it is known that an ink sucking operation directing ink toward the vicinity of discharge ports within a print head may be executed at each of predetermined time intervals in order to fill ink storage structures within the print head and prevent clogging in discharge ports. When such an ink sucking operation is executed, air bubbles may be produced within a channel used for conveying ink. It is possible for such air bubbles to cause defective discharge of ink in printing.

To address this issue, Japanese Patent Laid-Open No. 11-78068 discloses determining whether a predetermined time period has passed since execution of an ink sucking operation, and controlling the printing apparatus to maintain a standby state without starting ink discharging until the predetermined time period has passed. According to Japanese Patent Laid-Open No. 11-78068, because air bubbles occurring within a channel, if any, may disappear after a standby state is kept for a predetermined time period before starting ink discharging, by using the above techniques, printing can be executed without causing defective ink discharge during printing.

However, it has been found that the method disclosed in Japanese Patent Laid-Open No. 11-78068 may unnecessarily increase printing time because printing is not started until a predetermined time period has passed after execution of a sucking operation.

SUMMARY OF THE INVENTION

Various embodiments of the present application implement printing in which occurrence of defective discharges of ink due to an ink sucking operation can be prevented without unnecessarily increasing the printing time.

According to various embodiments of the present application, there is provided a printing apparatus for printing an image on a plurality of unit regions on a printing medium by ejecting ink from a print head, the print head having a discharge port array in which a plurality of discharge ports configured to discharge ink are aligned in a predetermined direction. During the printing, the print head moves relative to the printing medium in a cross direction intersecting the predetermined direction. In addition, the printing apparatus includes a suction unit configured to suck ink to the discharge ports within the print head, and a control unit configured to control a printing operation on each of the plurality of unit regions, wherein the control unit controls to (i) perform printing in a first print mode in a case where a time period from a time when the suction unit performs an ink sucking operation is higher than a first threshold value and (ii) perform printing in a second print mode in a case where the time period from a time when the suction unit performs an ink sucking operation is lower than the first threshold value, an ink discharge amount per unit time period in the second print mode being lower than an ink discharge amount per unit time period in the first print mode.

Further features of the present invention will become apparent from the following description of exemplary embodiments with reference to the attached drawings.

DESCRIPTION OF THE EMBODIMENTS

First Embodiment

A first embodiment of the present invention will be described in detail with reference to drawings.

Figure 1:
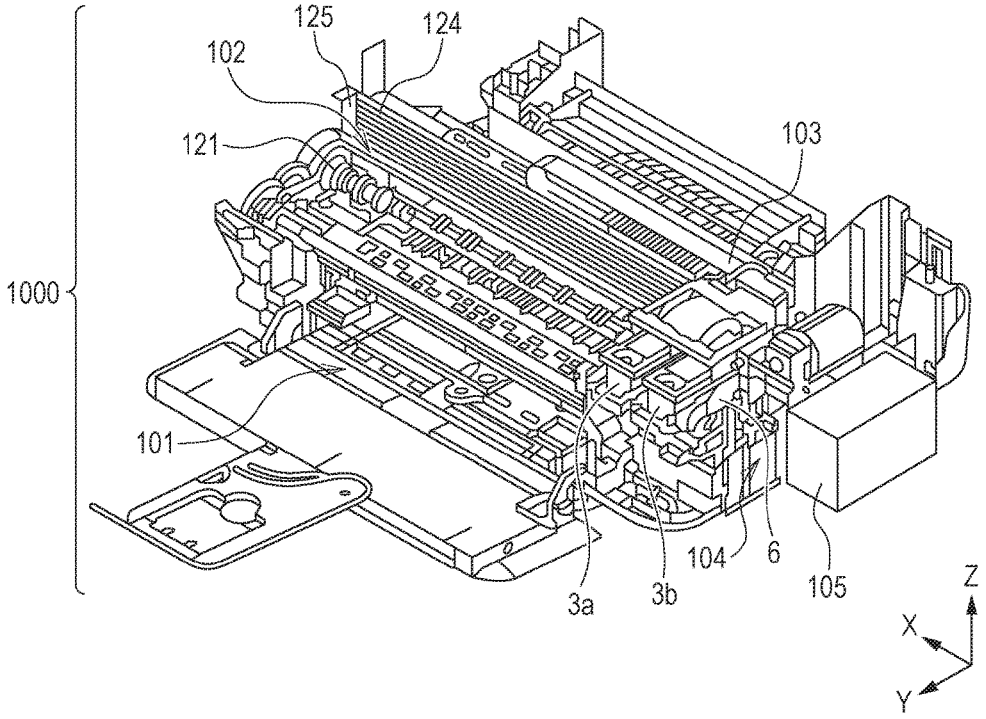
FIG. 1 is a perspective view of an image printing apparatus according to an embodiment.

FIG. 1 is a perspective view partially illustrating an internal configuration of a printing apparatus 1000 according to the first embodiment of the present invention.

As illustrated in FIG. 1, the printing apparatus 1000 includes a paper feeding unit 101, a conveying unit 102, a printing unit 103, and a recovery unit 104. The paper feeding unit 101 supplies a printing medium to the inside of the main body of the apparatus. The conveying unit 102 conveys a printing medium supplied by the paper feeding unit 101 in a Y direction (conveying direction). The printing unit 103 prints an image on a printing medium based on image information. The recovery unit 104 performs a recovery operation to maintain the ink discharge performance of the print head for retaining image quality for printing.

The paper feeding unit 101 conveys a printing medium to the inside of the main body of the apparatus. The printing medium loaded on the paper feeding unit 101 is fed out separately one by one by a paper feeding roller, not illustrated, driven by a paper feeding motor, not illustrated, and is conveyed to the conveying unit 102.

The conveying unit 102 conveys the recording material supplied by the paper feeding unit 101. The printing medium conveyed by the conveying unit 102 is pinched by a conveying roller 121 driven by a conveying motor, not illustrated, and a pinching roller, not illustrated, and is conveyed through the printing unit 103.

The printing unit 103 discharges ink from a print head onto a printing medium to print an image based on image data. The printing unit 103 includes a carriage 6 capable of back-and-forth moving in an X direction (cross direction) orthogonal to the Y direction and print heads 3*a* and 3*b* mounted on the carriage 6.

The carriage 6 is supported to be capable of back-and-forth moving in the X direction along a guide rail mounted in the printing apparatus. The carriage 6 back-and-forth moves in a printing area for printing on a printing medium through a carriage belt 124 driven by a carriage motor, not illustrated. The position and speed of the carriage 6 are detected by an encoder sensor, not illustrated, provided in the carriage 6 and an encoder scale 125 provided in the printing apparatus, and the movement of the carriage 6 is controlled based on the position and speed. While the carriage 6 is moving, ink is discharged from the print heads 3*a* and 3*b* to perform printing on a printing medium. After the printing medium has undergone the printing operation by the printing unit 103, the printing medium is pinched by a paper ejection roller, not illustrated, driven by the conveying unit 102 in synchronization with the conveying roller 121 and a driven roller, not illustrated, pressed by the paper ejection roller and then ejected to outside of the printing apparatus.

The recovery unit 104 includes a capping mechanism configured to seal the discharge port forming surface after printing is performed, which will be described below, and sucks ink to vicinity of a discharge port from an ink storage chamber, which will be described below, by applying negative pressure (suction pressure) from a suction pump, not illustrated, and a wiping mechanism configured to wipe a surface of the discharge port. The recovery unit 104 includes a slider, not illustrated, which is slidable within a predetermined region by following the movement of the carriage 6 when the carriage 6 moves toward the recovery unit 104.

The ink tank 105 which accommodates inks of different colors is connected to the ink storage chambers which store inks within the print heads using tubes (not illustrated). A sucking operation, which will be described below, sucks ink from the ink tank 105 to the ink storage chambers within the print heads, whereby the ink can be stored in the ink storage chambers. A user may execute an operation for directly filling color inks from a bottle, for example, into the ink tank 105.

Figure 2A:
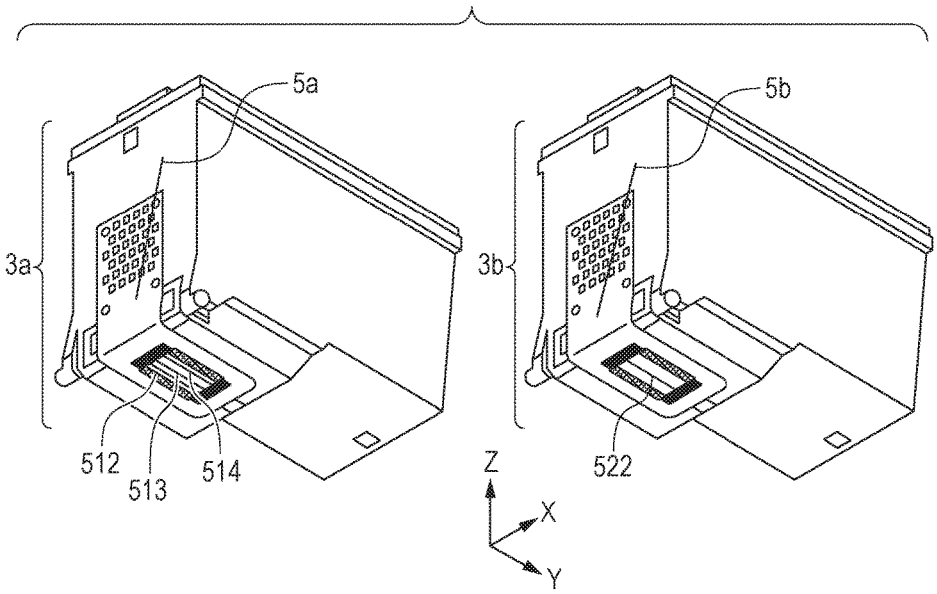
FIGS. 2A and 2B are perspective views of a print head according to an embodiment.

FIG. 2A illustrates the print heads 3*a* and 3*b* in detail according to this embodiment.

The print head 3*a* includes three ink storage chambers (not illustrated) which store a cyan ink, a magenta ink, and an yellow ink, respectively, that are chromatic color inks, and a printing unit 5*a* integrated with the ink storage chambers for discharging inks supplied from the ink storage chambers. These ink storage chambers will be described further below.

The print head 3*b* includes an ink storage chamber, not illustrated, which stores a black ink and a printing unit 5*b* integrated with the ink storage chamber, for discharging ink supplied from the ink storage chamber.

The ink storage chambers storing inks of different colors are provided externally to the print heads 3*a* and 3*b* and are connected to the ink tanks accommodating inks of different colors using tubes.

The printing unit 5*a* has a discharge port array 512 configured to discharge a cyan ink, a discharge port array 513 configured to discharge a magenta ink, and a discharge port array 514 configured to discharge an yellow ink, and the print head 5*b* has a discharge port array 522 configured to discharge a black ink.

Figure 2B:
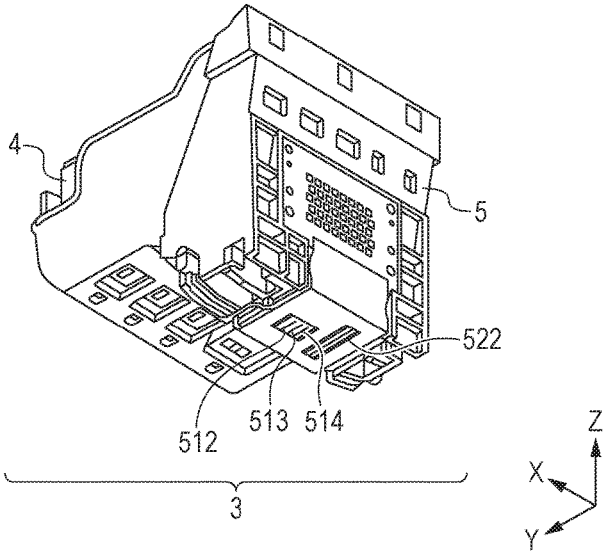

According to this embodiment, different print heads are provided for chromatic color inks and black inks as illustrated in FIG. 2A. However, the present invention may also be applicable to any other configurations. For example, a print head 3 may be applied which has a printing unit 5 integrally having the discharge port array 512 for cyan ink, discharge port array 513 for magenta ink, discharge port array 514 for yellow ink, and discharge port array 522 for black ink as illustrated in FIG. 2B. In the print head 3, the ink tank 4 storing inks of different colors is detachably attached to the printing unit 5 and can be replaced.

Figure 3A:
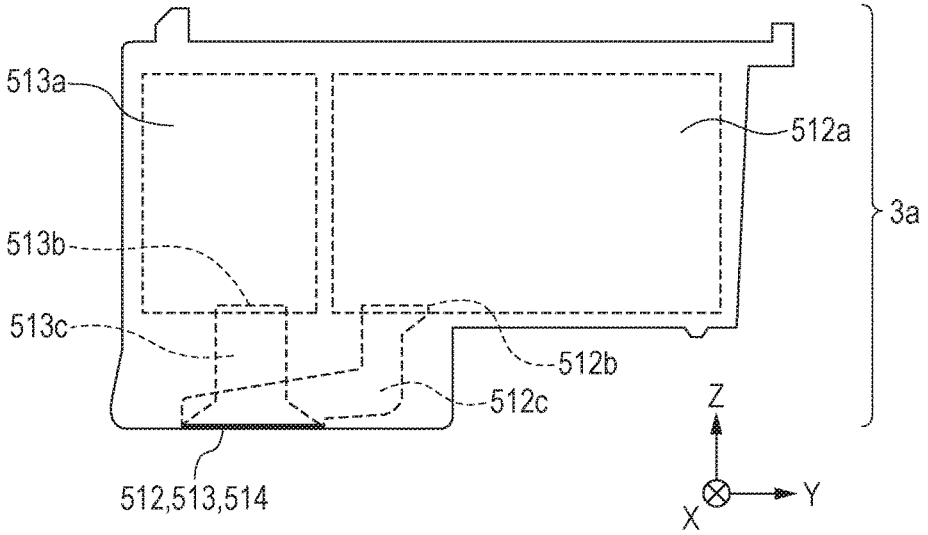
FIGS. 3A and 3B are transparent views of a print head according to an embodiment.
Figure 3B:
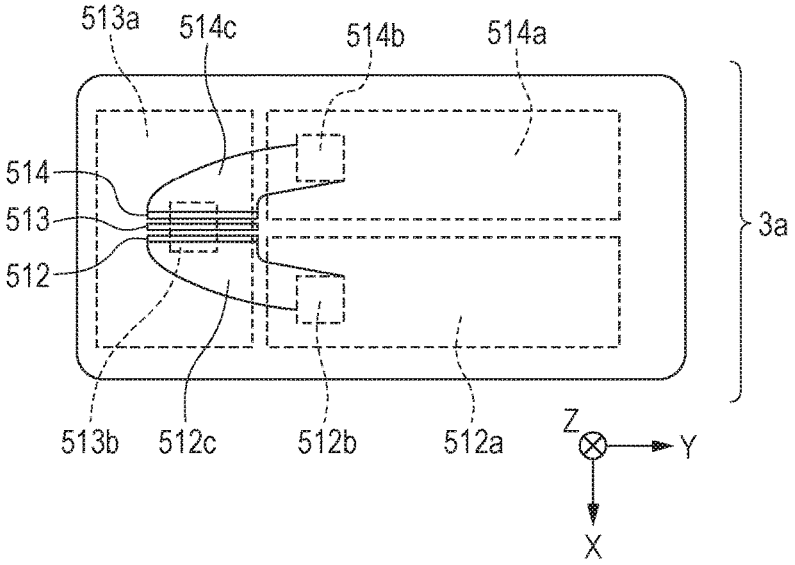

FIGS. 3A and 3B are transparent views illustrating an internal configuration of the print head 3*a* according to this embodiment. FIG. 3A illustrates a transparent view of the print head 3*a* from an upstream side in the X direction, and FIG. 3B illustrates a transparent view of the print head 3*a* from an upstream side in a Z direction.

Referring to FIG. 3B, the print head 3*a* according to this embodiment has a cyan ink storage chamber 512*a* and a yellow ink storage chamber 514*a* aligned in the X direction. The cyan ink storage chamber 512*a* is configured to store cyan ink, and the yellow ink storage chamber 514*a* is configured to store yellow ink. A magenta ink storage chamber 513*a* configured to store magenta ink is disposed adjacent in the Y direction to the cyan ink storage chamber 512*a* and the yellow ink storage chamber 514*a*. Each of the cyan ink storage chamber 512*a*, the magenta ink storage chamber 513*a*, and the yellow ink storage chamber 514*a*, has an absorbent for ink of the corresponding color, which is capable of absorbing and retaining the ink.

Referring to FIG. 3A, the cyan ink storage chamber 512*a* is connected to the channel 512*c* through a channel filter 512*b*. The other end of the channel 512*c* is connected to a plurality of discharge ports within the discharge port array 512 for cyan ink. This means that a plurality of discharge ports within the discharge port array 512 for cyan ink are connected to the cyan ink storage chamber 512*a* using the channel 512*c*.

Also, referring to FIG. 3A, a plurality of discharge ports within the discharge port array 513 for magenta ink and the magenta ink storage chamber 513*a* are connected to a channel 513*c* through a channel filter 513*b*. A plurality of discharge ports within the discharge port array 514 for yellow ink are also connected to the yellow ink storage chamber 514*a* using a channel 514*c* and through the channel filter 514*b* though it is not illustrated in FIG. 3A.

As illustrated in FIGS. 3A and 3B, the cyan ink storage chamber 512*a* and the yellow ink storage chamber 514*a* are placed at positions displaced in the Y direction from the discharge port array 512 for cyan ink and the discharge port array 514 for yellow ink, respectively. For that configuration, the channel 512*c* for cyan ink and the channel 514*c* for yellow ink have a relatively bending shape.

On the other hand, the magenta ink storage chamber 513*a* is placed at a position overlapping the discharge port array 513 for magenta ink in the Y direction. For that configuration, the channel 513*c* for magenta ink has a substantially straight shape without bending, compared to the channel 512*c* for cyan ink and channel 514*c* for yellow ink.

Figure 4A:
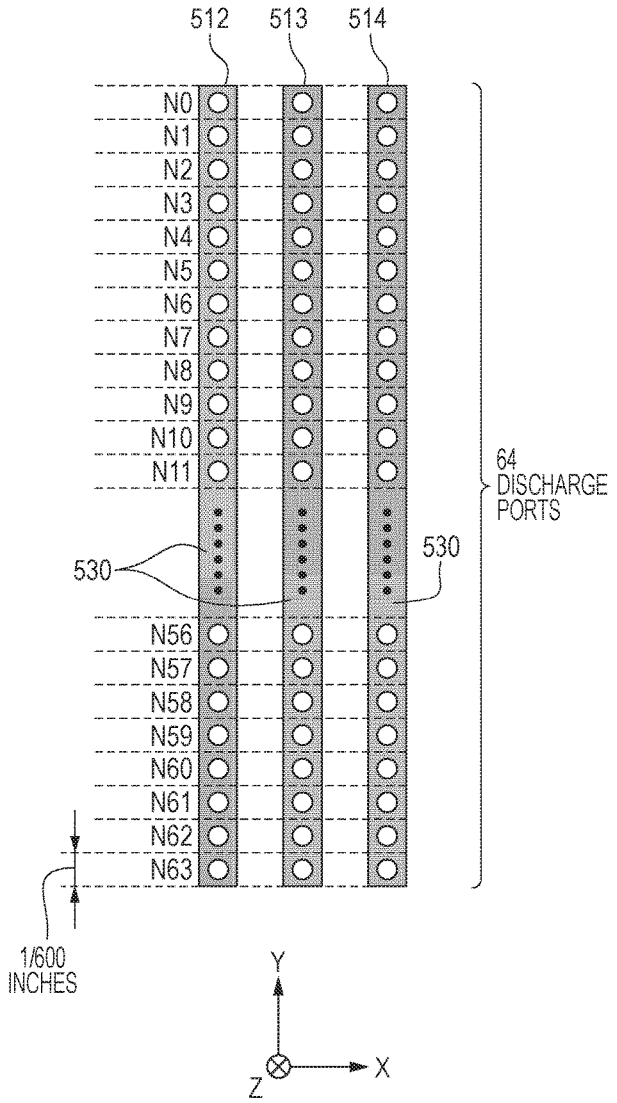
FIGS. 4A and 4B are schematic views of a discharge port forming surface according to an embodiment.
Figure 4B:
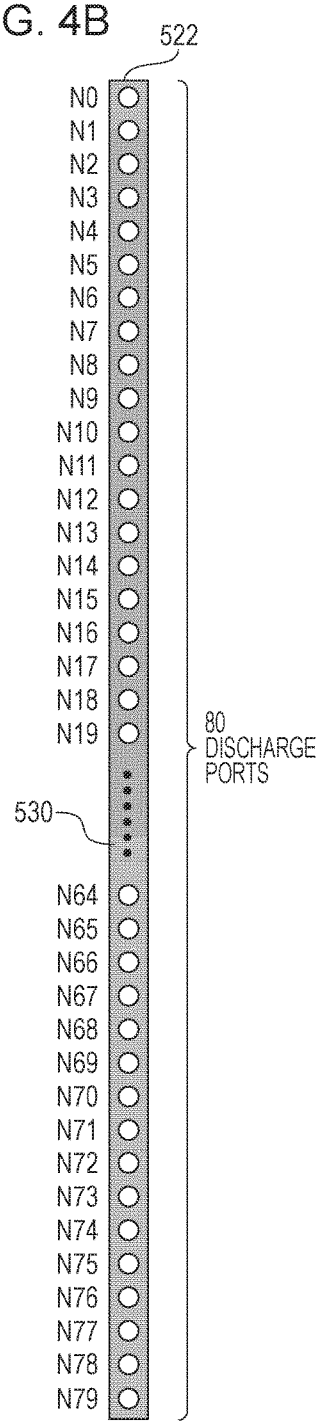

FIGS. 4A and 4B illustrate in detail the discharge port arrays according to this embodiment. FIG. 4A illustrates a surface having thereon the discharge port array within the printing unit 5*a* for chromatic color ink, and FIG. 4B illustrates a surface having thereon the discharge port array within the printing unit 5*b* for black ink.

According to one embodiment, each of the discharge port array 512 for cyan ink, the discharge port array 513 for magenta ink, and the discharge port array 514 for yellow ink, includes 64 discharge ports of a discharge port N0 through a discharge port N63 in the Y direction (or a predetermined direction) at a density of 1/600 inches (600 dpi) on a surface of a discharge port forming member 530. The discharge port array 522 configured to discharge black ink has 80 discharge ports of a discharge port N0 through a discharge port N79 in the Y direction at 600 dpi on a surface of the discharge port forming member 530.

Figure 5:
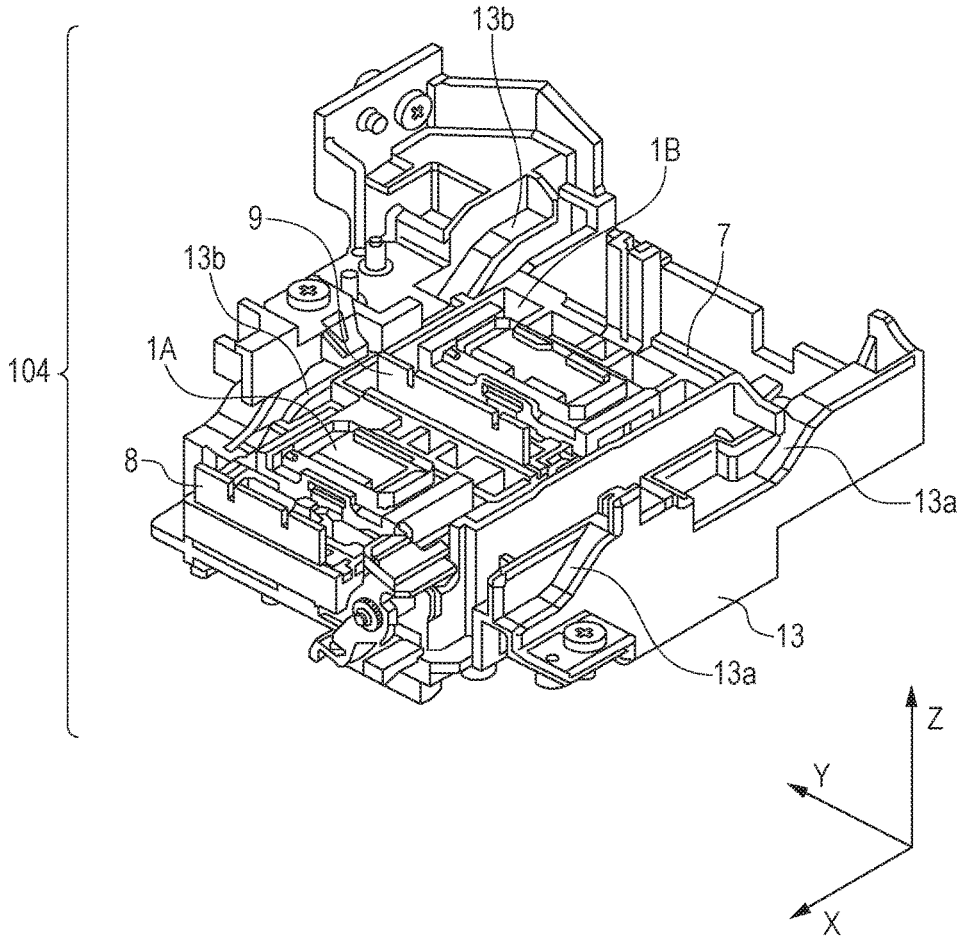
FIG. 5 is a perspective view of a recovery unit according to an embodiment.

FIG. 5 illustrates in detail a recovery unit 104 according to this embodiment.

A slider 7 functioning as a wiper holder has a cap 1A configured to cover the discharge ports in the discharge port array 512, the discharge port array 513, and the discharge port array 514, and a cap 1B configured to cover discharge ports in the discharge port array 522. The slider 7 further has a wiper 8 configured to wipe the surface having the discharge ports in the discharge port array 512, the discharge port array 513, and the discharge port array 514, and a wiper 9 configured to wipe the surface having the discharge ports in the discharge port array 522.

The slider 7 is configured to be movable in a predetermined region by following a movement of the carriage 6 toward the recovery unit 104. The slider 7 moves along cam faces of slider cams 13*a* and 13*b* provided in a slider base unit 13. Thus, the slider 7 can be controlled to have a predetermined height in the Z direction with respect to the surface having the discharge ports at each position along the moving direction of the carriage 6.

When the cap 1A is moved by the slider 7 to a capping position where it can seal the discharge port forming surface having the discharge port array 512, discharge port array 513, and discharge port array 514, the cap 1B at the same time can seal the discharge port forming surface having the discharge port array 522.

In order to perform a sucking operation, negative pressure (suction pressure) is applied from a suction pump, not illustrated, in a state where the caps 1A and 1*b* seal the discharge port forming surfaces. Thus, ink of each color can be sucked from the ink tank 105 to the corresponding ink storage chamber and from the ink storage chamber to the vicinity of the discharge ports.

The printing apparatus according to this embodiment is capable of performing two types of sucking operations. One of the two types of sucking operations is a first sucking operation with lower negative pressure (suction pressure) to be performed when a phenomenon occurs that a discharge port is blocked due to an increase in viscosity of ink, ink solidification, or attachment of dust, that is, clogging. Performing the first sucking operation can remove a blockage causing the clogging, to recover a discharge performance thereof.

The other type of sucking operation is a second sucking operation with higher negative pressure (suction pressure) to be performed for filling ink from the ink tanks to the corresponding ink storage chambers. The second sucking operation is performed to fill ink in the ink storage chambers upon first use of the printing apparatus after the print heads are mounted in the printing apparatus or to fill up ink in an ink tank after the remaining amount of ink within the ink tank is lower than a predetermined amount and to fill ink in the ink storage chamber again.

When the wipers 8 and 9 are moved by the slider 7 to wiping positions where they can wipe the surfaces of the discharge ports, the printing unit 103 and the recovery unit 104 are moved relatively in the X direction so that the wipers 8 and 9 can be brought in contact with the surfaces of the discharge ports to wipe the surfaces of the discharge ports. The slider 7 is configured to be capable of moving in the Z direction to the wiping positions and wiper retractable positions where the wipers 8 and 9 can be apart from the print heads.

Figure 6:
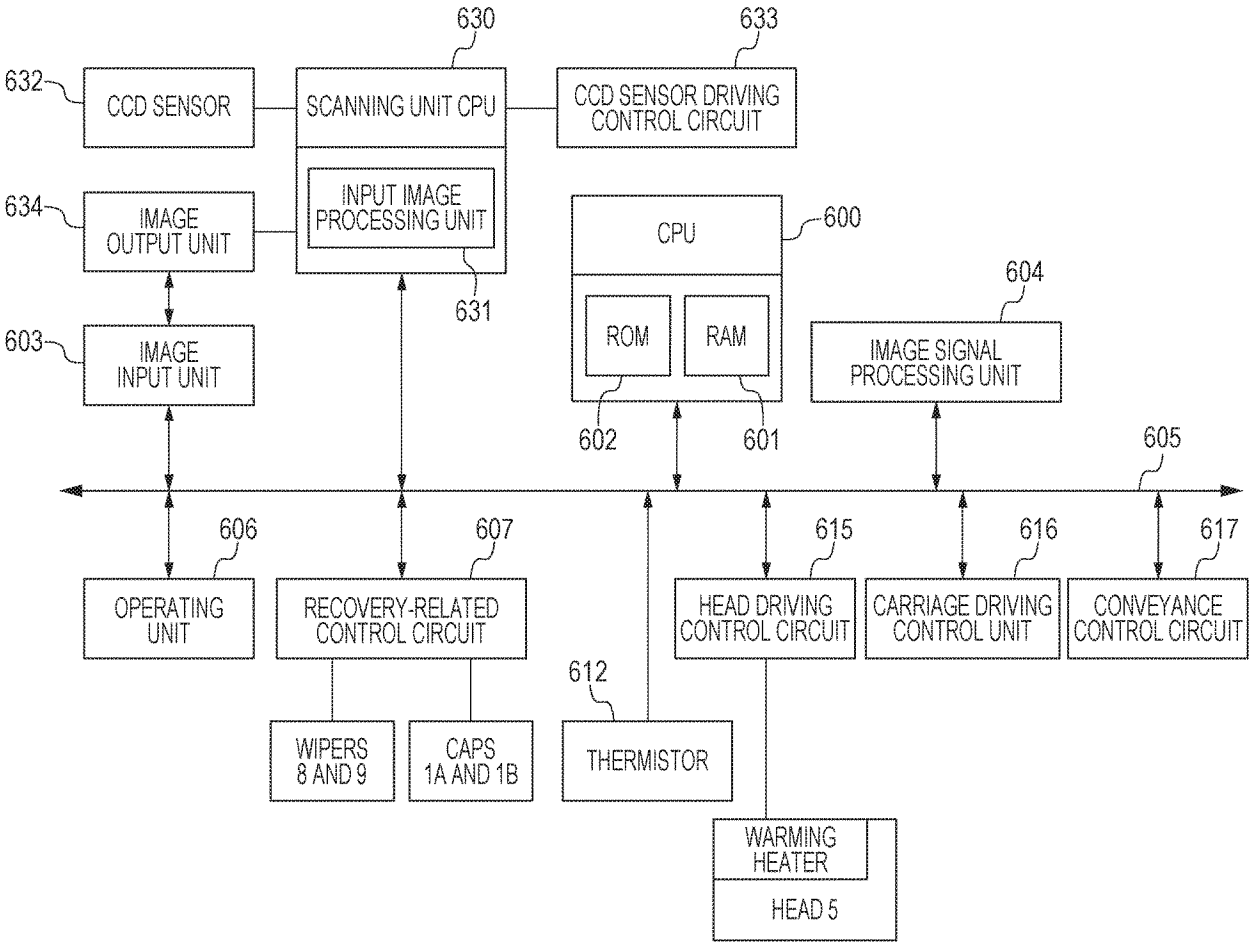
FIG. 6 is a block diagram illustrating a printing control system according to an embodiment.

FIG. 6 is a block diagram illustrating a configuration of the printing control system according to this embodiment.

A CPU 600 executes control and data processing over components, which will be described below, through a main bus line 605. In other words, the CPU 600 executes head drive control, carriage drive control and data processing control through components, which will be described below, in accordance with programs stored in a ROM 602.

A RAM 601 is used as a work area for data processing to be performed by the CPU 600, and a hard disk, for example, may sometimes be used instead. An image input unit 603 has an interface to a host computer (not illustrated) and temporarily holds an image input from the host apparatus. An image signal processing unit 604 performs data processing such as color conversion processing which converts RGB data being input image data to CMYK data and binarization processing which binarizes multivalued CMYK data.

A CPU 630 responsible for control over a scanning unit such as a scanner has an input image processing unit 631 and is connected to a CCD sensor 632, a CCD sensor drive unit 633, an image output unit 634 and the main bus line 605. The CCD sensor drive unit 633 controls input drive of the CCD sensor. The input image processing unit 631 may perform processing such as A/D conversion and shading correction on a signal from the CCD sensor 632. The image processed by the input image processing unit 631 is transmitted to the image input unit 603 through the output unit 634.

An operating unit 606 has a start key and so on through which a user can perform control. A recovery-related control circuit 607 controls recovery operations such as a suction and an auxiliary discharge in accordance with recovery processing programs stored in the ROM 602. In other words, the recovery-related control circuit 607 drives the print head 5, the wipers 8 and 9, and the caps 1A and 1B.

A head driving control circuit 615 controls driving of an electrothermal conversion member for ink discharging of the print head 5 to cause the print head 5 to perform auxiliary discharge and ink discharge for printing. A carriage driving control circuit 616 and a conveyance control circuit 617 control movements of the carriage 6 and conveyance of a printing medium, respectively, also in accordance with programs.

The substrate having the electrothermal conversion member for ink discharging of the print head 5 further has a warming heater configured to increase the temperature of ink within the print head 5 to a target temperature. A thermistor 612 is provided on the substrate and is configured to measure a substantial temperature of ink within the print head. The thermistor 612 may not be provided on the substrate but may be provided externally or in the vicinity of the print head 5.

Mechanism for Causing Defective Discharge Due to Sucking Operation

Figure 7A:
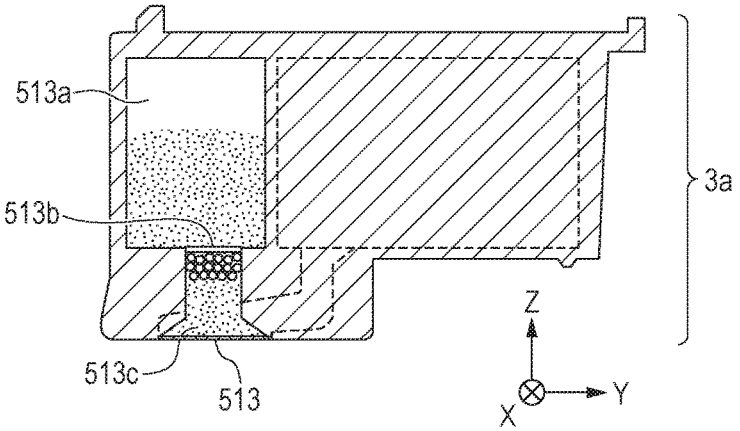
FIGS. 7A to 7C illustrate a mechanism of occurrence of a defective ink discharge which occurs in connection with a sucking operation.
Figure 7B:
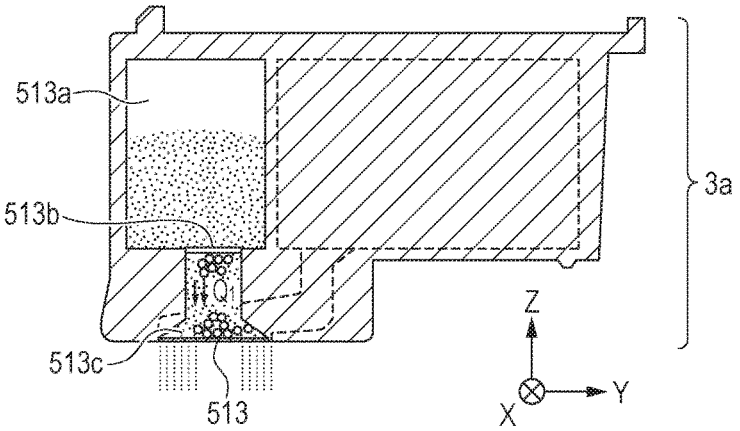
Figure 7C:
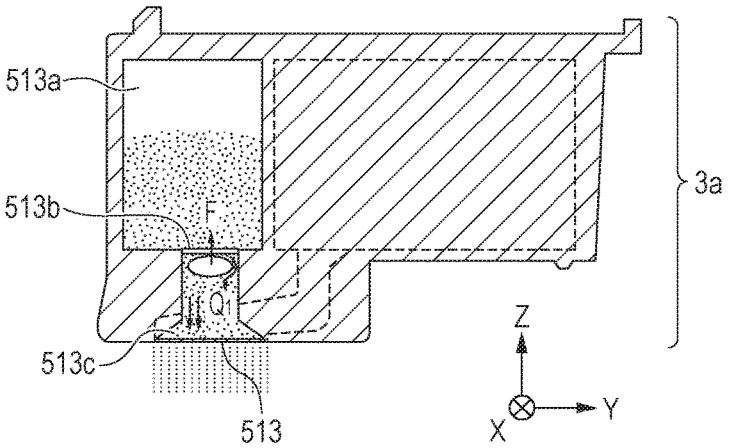

FIGS. 7A to 7C illustrate a mechanism for causing air bubbles within a channel when the sucking operations are performed and for causing a defective ink discharge due to the air bubbles. The following description focuses on magenta ink among cyan ink, yellow ink, magenta ink, and black ink, as an example.

FIG. 7A is a transparent view illustrating an internal state of the print head immediately after a sucking operation is performed. FIG. 7B is a transparent view of an internal state of the print head when a discharge operation is performed with a higher discharge amount of ink immediately after a sucking operation is performed and air bubbles are formed. FIG. 7C is a transparent view illustrating an internal state of the print head when a discharge operation is performed with a higher discharge amount of ink after a lapse of a certain time period from the time when the sucking operation is performed.

Immediately after a sucking operation is performed, minute air bubbles may be formed within the channel 513*c*, as illustrated in FIG. 7A. This may be caused by bringing air within the ink storage chamber 513*a* together with ink brought into the channel 513*c* by the sucking operation.

The second sucking operation of the two types of sucking operation may significantly form such air bubbles. This may be because a higher amount of air may be brought by the second sucking operation which sucks ink with higher negative pressure (suction pressure) as described above.

When an ink discharge operation with a higher ink discharge amount is performed immediately after minute air bubbles are formed as a result of the sucking operation, a relatively stronger ink flow Q1 may occur within the channel 513*c*, as illustrated in FIG. 7B. As a result, the minute air bubbles caused by the sucking operation are carried by the ink flow Q1 to the vicinity of the discharge port array 513, which may possibly block the discharge ports or the vicinity of the discharge ports (hereinafter, which is also expressed as "block discharge ports"). The blockage of discharge ports with air bubbles may hinder ink discharging from the discharge ports within the discharge port array 513.

After a lapse of a certain time period from a time when the sucking operation is performed, on the other hand, minute air bubbles caused by the sucking operation may be merged to form a large air bubble, as illustrated in FIG. 7C. A large air bubble has a higher buoyancy F than that of a minute air bubble, which increases as the volume of the air bubble increases. Thus, the large air bubble acts against the ink flow Q1 because of the buoyancy F even when an ink discharge operation with a higher discharge amount is performed and therefore the large air bubble stays in the vicinity of the filter 513*b*. As a result, after a lapse of a certain time period from a time when a sucking operation is performed, blockage of discharge ports with air bubbles may not occur even when an ink discharge operation with a higher discharge amount is performed.

Control for Suppressing Occurrence of Defective Discharge Immediately after Sucking Operation is Performed As described with reference to FIG. 7B, when an ink discharge operation is performed for printing immediately after a sucking operation is performed, minute air bubbles may reach the vicinity of a discharge port array and may possibly cause a defective discharge. According to this embodiment, printing is performed under a condition that the ink flow rate per unit time period is lower immediately after a sucking operation is performed.

Figure 8:
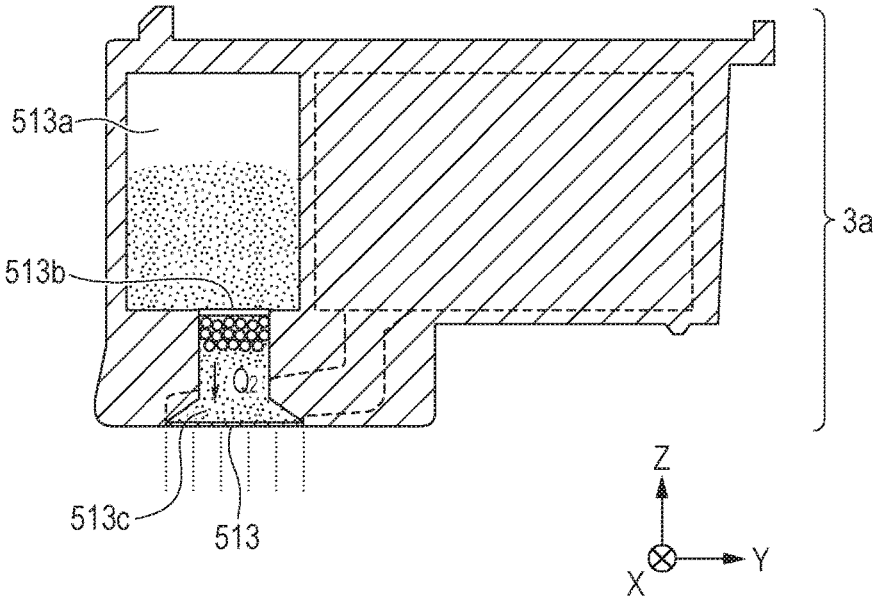
FIG. 8 illustrates a mechanism for suppressing a defective ink discharge according to an embodiment.

FIG. 8 is a cross section view illustrating an internal state of a print head when an ink discharge operation with a lower discharge amount is performed immediately after air bubbles are formed by a sucking operation, as illustrated in FIG. 7A.

As illustrated in FIG. 8, when a discharge operation with a lower ink discharge amount is performed immediately after minute air bubbles are formed as a result of a sucking operation, an ink flow Q2 caused within the channel 513*c* is lower than the ink flow Q1 when a discharge operation with a higher discharge amount is performed as illustrated in FIG. 7B. Thus, unlike the case illustrated in FIG. 7B, even minute air bubbles act against the lower ink flow Q2 because of their buoyancy and can stay in the vicinity of the filter 513*b*. Thus, the air bubbles do not reach the discharge port arrays so that printing can be performed without causing blockage of discharge ports with the air bubbles.

Printing Control

In view of these matters, according to this embodiment, in order to perform printing on a unit region on a printing medium, the time period from a time when a sucking operation is performed is measured, and printing is performed in a print mode corresponding to the measured time period.

More specifically, when the measured time period is higher than a threshold time T_Th, larger air bubbles are formed and do not block the discharge ports easily. Thus, printing is performed in a print mode having a higher ink flow rate per unit time period. Therefore, high speed printing can be performed.

On the other hand, when the measured time is lower than the threshold time T_Th, formed air bubbles may possibly block the discharge ports. For that, printing is performed in a print mode having a lower ink flow rate per unit time. By applying these print modes, printing can be performed such that blockage of discharge ports with air bubbles can be prevented without stopping the printing even when minute air bubbles are formed.

The printing control according to this embodiment will be described in detail below.

First of all, according to this embodiment, a timer is used to measure a time period passed from a time point when a second sucking operation is performed and is completed, the second sucking operation determined as between a first sucking operation with a lower negative pressure and the second sucking operation with a higher negative pressure. A print mode is selected in accordance with the time measured by the timer for performing printing on each of a plurality of unit regions on a printing medium.

Figure 9:
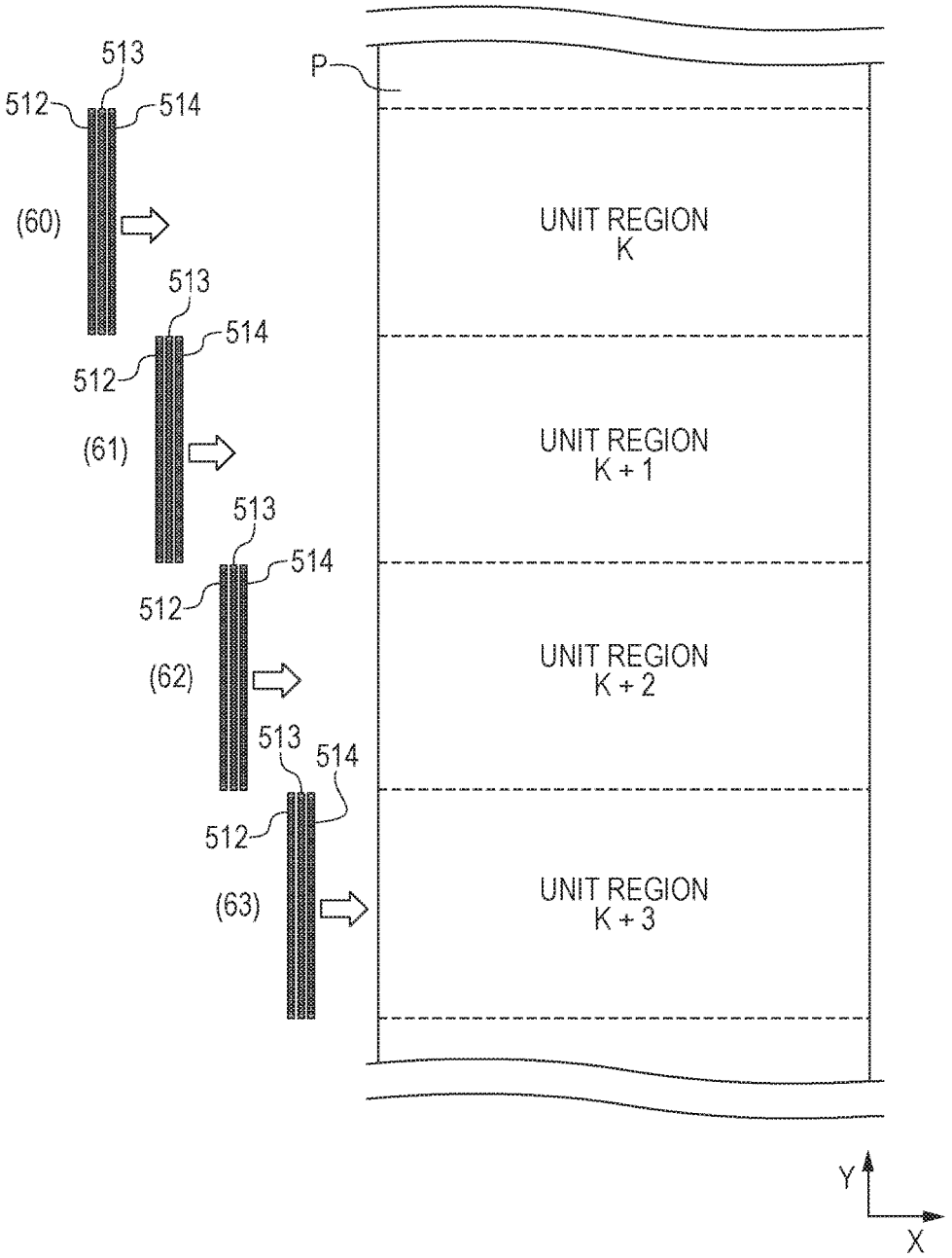
FIG. 9 illustrates a printing operation according to an embodiment.

FIG. 9 is a schematic diagram illustrating the printing control according to this embodiment.

According to this embodiment, a printing medium P is divided along the Y direction so as to have a width corresponding to the length in the Y direction of each of the discharge port arrays 512, 513, and 514 as illustrated in FIG. 9, and a print mode is selected for each divided unit region for performing printing thereon sequentially. FIG. 9 illustrates four unit regions K, K+1, K+2, and K+3 on a printing medium.

First, a time period passed from a time when the second sucking operation is performed is measured when the discharge port arrays 512, 513, and 514 and the printing medium P have a positional relationship in which the discharge port arrays 512, 513, and 514 and the unit region K face each other in the Y direction (60), and a print mode for the unit region K is selected in accordance with the measured time period. In accordance with the selected print mode, the printing unit 103 performs a printing operation.

After the printing on the unit region K completes, the printing medium P is conveyed toward a downstream side in the Y direction by a distance corresponding to the length of the discharge port arrays 512, 513, and 514 in the Y direction, that is, the length in the Y direction of one unit region. Thus, after the conveyance completes, the discharge port arrays 512, 513, and 514 and the printing medium P have a positional relationship in which the discharge port arrays 512, 513, and 514 and the unit region K+1 face each other in the Y direction as indicated by (61). The time period passed from a time when the second sucking operation is performed in timing when the discharge port arrays 512, 513, and 514 and the printing medium P have the positional relationship indicated by (61) in the Y direction, and a print mode for the unit region K+1 is selected. In accordance with the selected print mode, the printing unit 103 performs printing.

Also after this, the conveyance of the printing medium toward a downstream side in the Y direction by a distance corresponding to the length in the Y direction of one unit region, selection of a unit region corresponding to the time period elapsed from the second sucking operation and execution of printing on the unit region in accordance with the selected print mode are sequentially repeated to complete printing of an image on the entire area of the printing medium.

Figure 10:
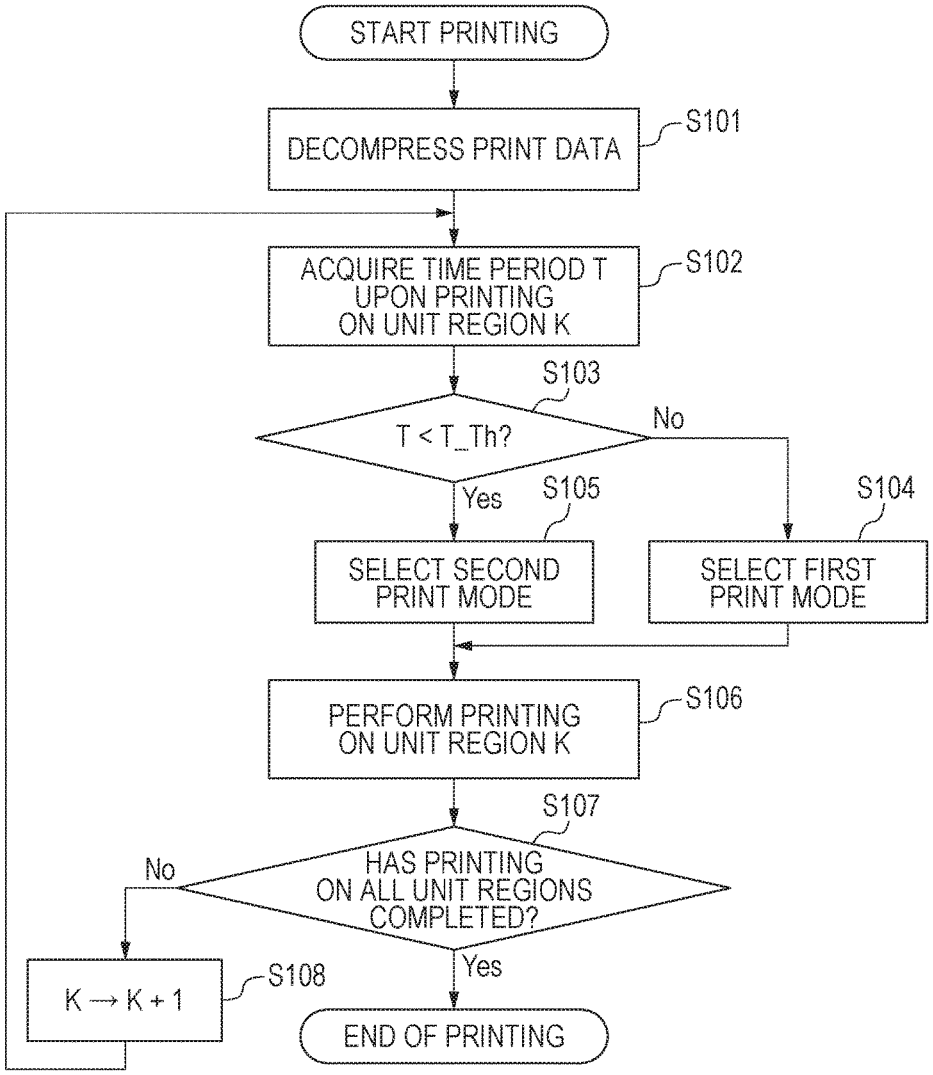
FIG. 10 is a flowchart illustrating a printing control according to an embodiment.

FIG. 10 is a flowchart of print mode selection control and printing control to be executed by a CPU in accordance with control programs according to this embodiment.

First of all, in step S101, print data is decompressed. In this case, binary print data corresponding to cyan, magenta, yellow, and black inks, is decompressed, the print data generated based on image data corresponding to an image to be printed on a printing medium.

Next, in step S102, a time period T from a time when the second sucking operation is performed is acquired, which is measured by the timer when printing on one unit region is started. As an example, printing is performed on the unit region K illustrated in FIG. 9, and the time period T is acquired at a time point when the printing on the unit region K starts.

Next, in step S103, the time period T passed from a time when the second sucking operation is performed, which is acquired in step S102, and a threshold time T_Th prestored in the ROM 602 are compared. If it is determined that the time period T is higher than the threshold time T_Th, the processing moves to step S104 where a first print mode with higher ink flow rate per unit time period, which will be described below, is selected as a print mode to be applied to the unit region K. On the other hand, if it is determined that the time period T is lower than the threshold time T_Th, the processing moves to step S105 where a second print mode with a lower ink flow rate per unit time period, which will be described below, is selected as a print mode to be applied to the unit region K.

In step S106, a printing operation is performed on the unit region K in accordance with the print mode selected in step S105 or step S104.

After that, in step 107, whether printing on all unit regions on the printing medium has completed or not is determined.

If it is determined that the printing has not completed, the printing medium is conveyed toward the downstream side in the Y direction such that a positional relationship is acquired in which the next unit region and the discharge port arrays face each other for printing on the next unit region on which printing is to be performed next, in step S108. Because printing has been performed on the unit region K first, printing is performed next on the unit region K+1 illustrated in FIG. 9. Returning to step S102 again, a time period T passed from a time when the second sucking operation is performed is acquired in turn when printing on the unit region K+1 starts. The same processing S102 to S107 is repeated until it is determined in step S107 that printing on all unit regions has completed.

If it is determined in step S107 that printing on all unit regions has completed, printing on the printing medium ends.

The first print mode and the second print mode applicable according to this embodiment will be described in detail below.

According to this embodiment, in order to control the ink flow rate per unit time period, scanning is performed on a unit region a different number of times in the first print mode than in the second print mode. More specifically, the number of times of scanning on a unit region in the second print mode is higher than the number of times of scanning on the unit region in the first print mode. Thus, in the second print mode, because the ink discharge amount per one scanning can be lower than that in the first print mode even when identical print data are input, the ink flow rate per unit time period can be reduced.

Figure 11:
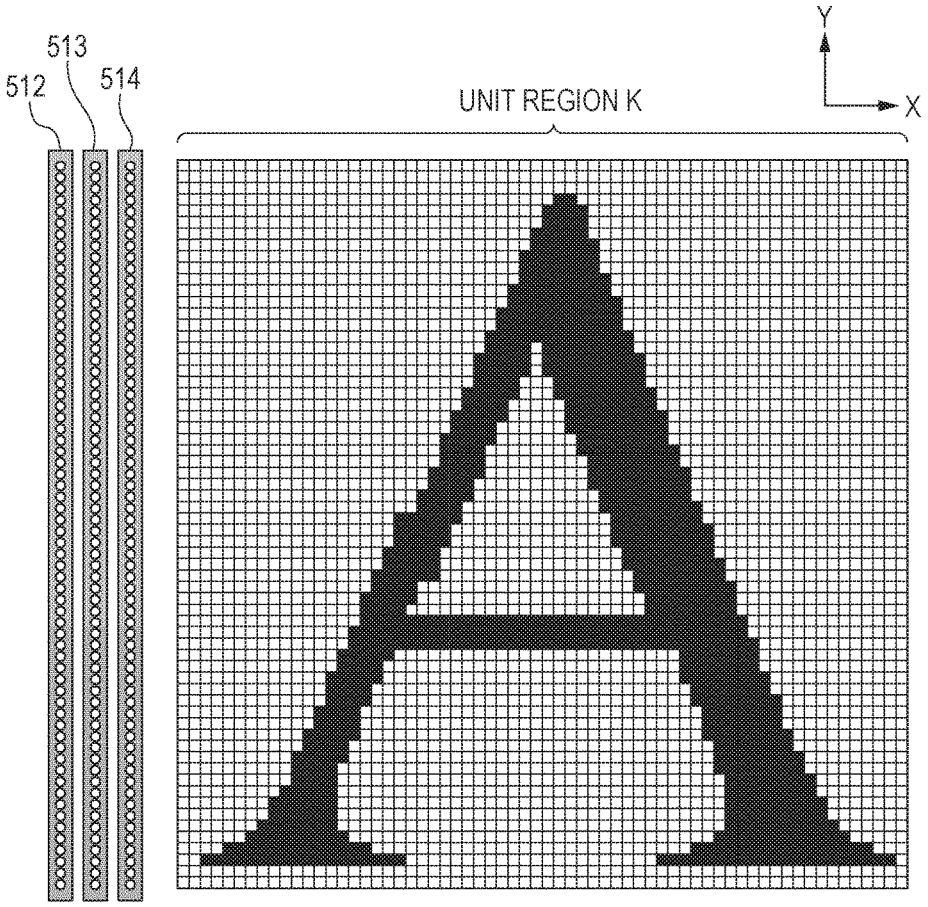
FIG. 11 illustrates a first print mode according to an embodiment.

FIG. 11 is a schematic diagram showing a detailed description of the first print mode according to this embodiment.

In the first print mode according to this embodiment, one scanning operation on one unit region on a printing medium is performed to print an image. FIG. 11 illustrates black parts to which ink is discharged after one scanning operation and white parts to which ink is not discharged after one scanning operation.

According to this embodiment, the first print mode is selected as a print mode to be applied because minute air bubbles are merged to a larger air bubble after a lapse of a certain time period from the second sucking operation. Thus, the air bubbles do not block the discharge ports even when the ink flow rate per unit time period is higher.

In view of this matter, an image is completed by one scanning operation performed on one unit region as illustrated in FIG. 11 in the first print mode according to this embodiment so that the printing on the unit region can be completed in a short time period.

Figure 12A:
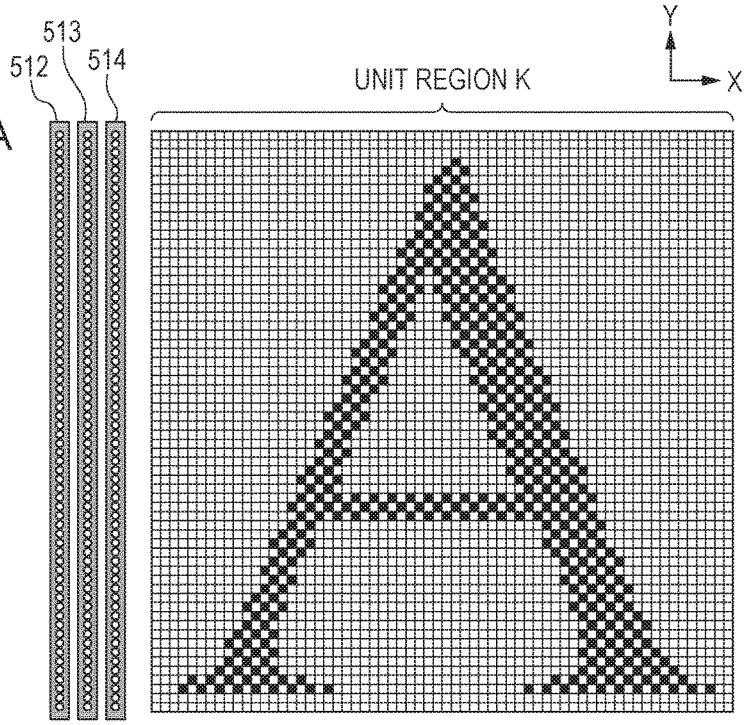
FIGS. 12A and 12B illustrate a second print mode according to an embodiment.
Figure 12B:
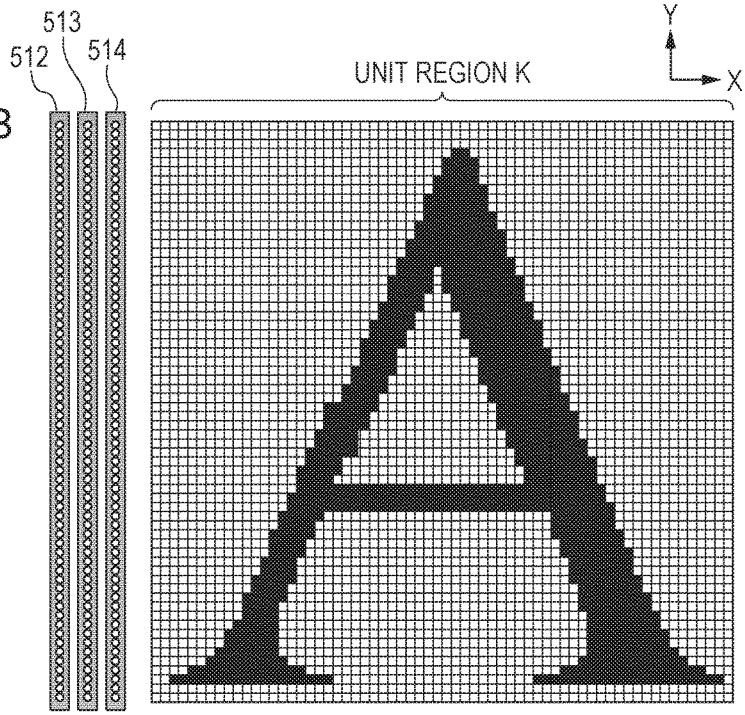

FIGS. 12A and 12B are schematic views showing a detailed description of the second print mode according to this embodiment.

In the second print mode according to this embodiment, scanning is performed two times on one unit region on the printing medium. FIG. 12A illustrates an image printed by a first scanning operation, and FIG. 12B illustrates an image printed by a second scanning operation. FIGS. 12A and 12B illustrate black parts to which ink is discharged after the scanning operations are performed and white parts to which ink is not discharged after the scanning operations are performed.

According to this embodiment, the second print mode is selected as a print mode to be applied because a sufficient time period has not passed from a time when the second sucking operation is performed and blockage of discharge ports with minute air bubbles may still possibly occur due to the ink discharging.

In view of this matter, the image signal processing unit 604 performs thinning-out processing on print data for the two scanning operations in the second print mode according to this embodiment to perform control to reduce the discharge amount of one scanning operation. Because of this, after the first scanning operation is performed, a part of the image is only printed as illustrated in FIG. 12A. By performing the second scanning operation, an image as illustrated in FIG. 12B is completely printed. In the second print mode, print data are thinned in the two scanning operations as described above. Thus, the ink flow rate per unit time period can be reduced, whereby air bubbles if formed may not reach the vicinity of the discharge ports and may not block the discharge ports for printing.

With this configuration, in a case where a large air bubble is formed by merging minute air bubbles due to a sucking operation, printing is performed in a short time period. Thus, even when minute air bubbles due to a sucking operation are formed, printing can be performed in this manner to prevent defective discharges without stopping the printing.

Second Embodiment

According to the first embodiment, a time period elapsed from a time when a sucking operation is performed is measured at a time point when printing is performed on a unit region on a printing medium, and a print mode is selected for the unit region in accordance with the measured time period.

According to a second embodiment for performing printing on a unit region, on the other hand, a print mode for a unit region on which printing is to be performed is selected in accordance with the time period elapsed from a time when a sucking operation is performed and an ink discharge amount for the unit region.

Any repetitive description regarding the parts similar to those of the first embodiment will be omitted.

When minute air bubbles are formed because an insufficient time period has passed from the occurrence of a second sucking operation, as described with reference to FIGS. 7A to 7C, performing an ink discharge operation with a higher discharge amount may possibly result in blockage of discharge ports with the minute air bubbles in the flow Q1. However, in a case where the ink discharge amount per unit region is lower, the flow is also weakened. As a result, minute air bubbles, if any, may not easily reach the vicinity of discharge ports. In other words, even in a case where the time period passed from a time when a sucking operation is performed is shorter than desirable for printing on a unit region, blockage of the discharge ports with minute air bubbles may not easily occur if the ink discharge amount for the unit region is lower.

In view of these matters, printing is performed in the first print mode on a unit region according to this embodiment when a larger air bubble may be formed as illustrated in FIG. 7C because the time period passed from a time when a sucking operation is performed is longer for printing on a unit region. In a case where the time period passed from a time when a sucking operation is performed is shorter and where the ink discharge amount for a unit region is higher, printing is performed in the second print mode because minute air bubbles due to the flow Q1 that is strong may possibly block the discharge ports as illustrated in FIG. 7B. In a case where the time period passed from a time when a sucking operation is performed is shorter and where the ink discharge amount for a unit region is lower, printing in the first print mode is performed because a weak flow may be caused and minute air bubbles may therefore not reach the vicinity of the discharge ports.

Figure 13:
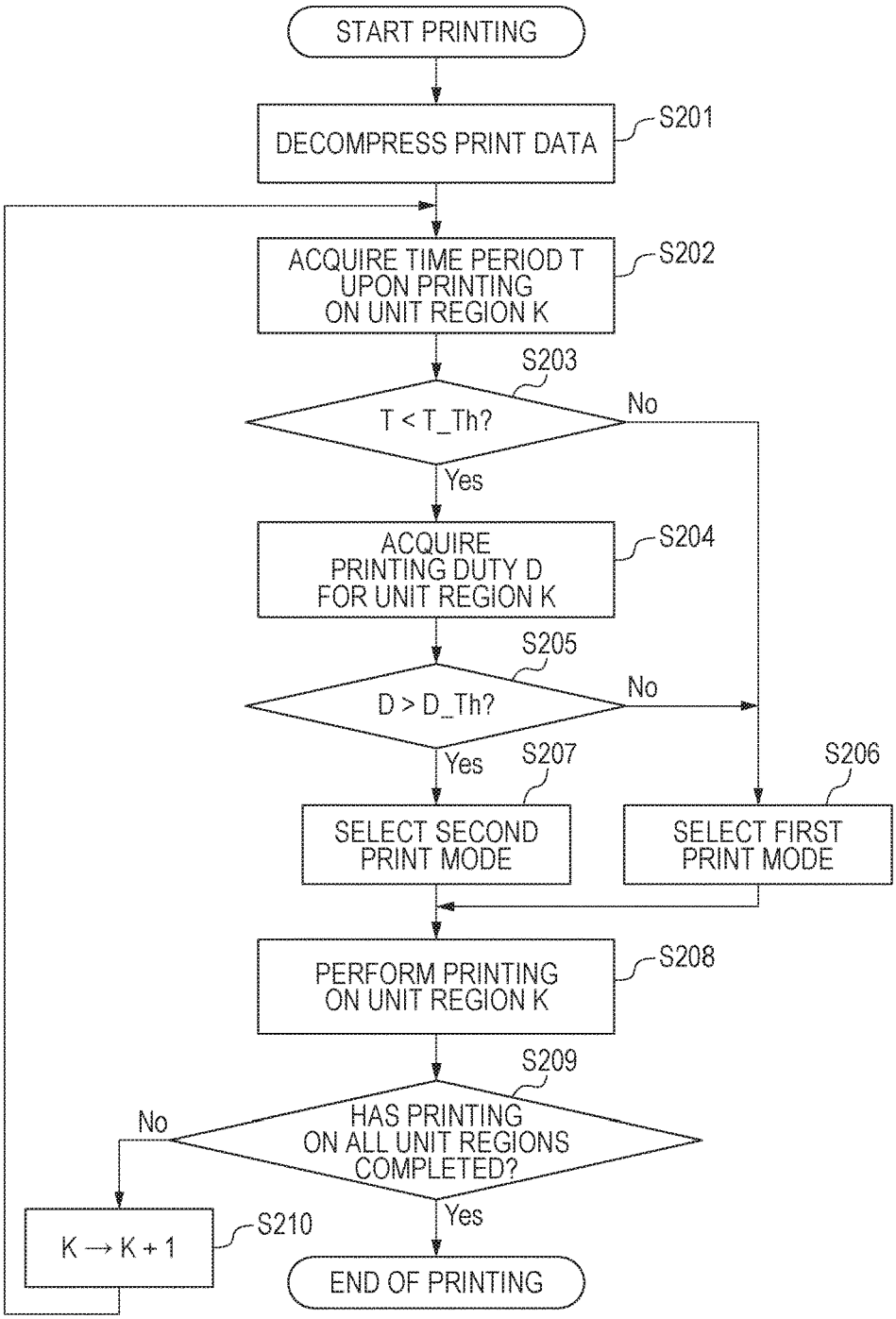
FIG. 13 is a flowchart illustrating printing control according to an embodiment.

FIG. 13 is a flowchart of print mode selection control and printing control to be executed by a CPU in accordance with control programs according to this embodiment.

Because processing in steps S201, S202, and S208 to S210 is the same as the processing in steps S101, S102, and S106 to S108 in FIG. 10, any repetitive description will be omitted.

In step S203, a time period T passed from a time when the second sucking operation is performed to a time when printing on a unit region K is to be performed and the threshold time T_Th are compared, like the first embodiment. More specifically, if it is determined that the time period T is higher than the threshold time T_Th, the processing moves to step S206 where the first print mode is selected as a print mode for the unit region. If it is determined that the time period T is lower than the threshold time T_Th on the other hand, the processing moves to step S204.

In step S204, a print duty D of each of color inks including a cyan ink, a magenta ink, and an yellow ink for the unit region K are acquired as information regarding the discharge amounts of the color inks.

The term "print duty D" of each color ink here refers to a value indicative of a ratio of an actual number of times of ink discharging to a unit region to the possible number of times of ink discharging to the unit region. For example, with respect to a unit region corresponding to a total of 4096 pixels including 64 pixels in the X direction by 64 pixels in the Y direction, in a case where print data are defined such that 1024 pixels discharge cyan ink, the print duty D for cyan ink is equal to 25 (=1024/4096×100)%.

Then in step S205, the print duty D of each color ink acquired in step S204 and a threshold discharge amount D_Th prestored in the ROM 602 are compared. According to this embodiment, an equal threshold discharge amount D_Th is used for all of color inks. More specifically, the threshold discharge amounts D_Th applied for color inks are all equal to 50%.

More specifically, if it is determined that the print duty D for the unit region K of all color inks is lower than the threshold discharge amount D_Th, the processing moves to step S206 where the first print mode is selected as a print mode for the unit region K. This is because, though minute air bubbles may possibly be formed in all color inks, the minute air bubbles may not reach the vicinity of discharge ports due to a weaker flow of the all color inks within channels even when the first print mode with a lower number of scanning operations is selected.

On the other hand, if it is determined that a print duty for the unit region K of one of inks of colors is higher than the threshold discharge amount D_Th, the processing moves to step S207 where the second print mode is selected as a print mode for the unit region K. This is because minute air bubbles may possibly be formed in all color inks and the minute air bubbles may reach the vicinity of discharge ports due to a stronger flow of ink within partial channels when the first print mode with a lower number of scanning operations is selected to be performed, which may possibly cause a defective discharge.

Then in step S208, printing on the unit region K is performed in accordance with the print mode selected in step S206 or step S207. The subsequent processing is the same as that of the first embodiment.

With this configuration, in a case where a large air bubble is formed by merging minute air bubbles due to a sucking operation, printing can be performed in a short time period. Furthermore, even when minute air bubbles due to a sucking operation are formed, printing can be performed in a short time period if the ink discharge amount is smaller and the minute air bubbles do not reach vicinity of the discharge ports easily. In a case where the ink discharge amount is larger and minute air bubbles may possibly reach the vicinity of the discharge ports, printing can be performed by preventing defective discharges without stopping the printing.

Third Embodiment

According to the second embodiment, the threshold discharge amounts D_Th corresponding to inks are equal irrespective of the types of ink.

According to a third embodiment, the threshold discharge amount D_Th is changed in accordance with the type of ink.

Any repetitive description regarding the parts similar to those of the first and second embodiments will be omitted.

According to this embodiment, a threshold discharge amount D_ThC corresponding to cyan ink, a threshold discharge amount D_ThM corresponding to magenta ink and a threshold discharge amount D_ThY corresponding to yellow ink are differentiated in accordance with the densities of the surfactant contained in the ink of the colors and the shapes of the channels 512*c*, 513*c*, and 514*c* within the print head 3*a* corresponding to the inks of the colors.

Densities of Surfactant Contained in Ink

According to this embodiment, cyan ink, magenta ink, and yellow ink contain C.I. Direct Blue 199, C.I. Acid Red 249, and C.I. Direct Yellow 132 being dyes as coloring materials and contain Acetylenol E100 as a surfactant.

Table 1 illustrates detail compounding ration of components of cyan ink, magenta ink, and yellow ink applied according to this embodiment. Table 1 illustrates the ration based on their masses.

TABLE 1

| | Cyan Ink | Magenta Ink | Yellow Ink |
|---|---|---|---|
| C.I. Direct Blue 199 | 3 | 0 | 0 |
| C.I. Acid Red 249 | 0 | 3 | 0 |
| C.I. Direct Yellow 132 | 0 | 0 | 3 |
| glycerin | 10 | 7 | 10 |
| Triethylene Glycol | 0 | 0 | 5 |
| Ethylene urea | 5 | 5 | 5 |
| Bis(hydroxyethyl) sulfone | 5 | 5 | 5 |
| 3-Methyl-1.5-pentanediol | 10 | 10 | 5 |
| Acetylenol E100 | 1 | 15 | 10 |
| deionized water | remainder | remainder | remainder |

As illustrated above, according to this embodiment, all of cyan ink, magenta ink, and yellow ink contain the same Acetylenol E100 as a surfactant, and the density of the surfactant increases in order of magenta ink, yellow ink, and cyan ink.

Here, according to the examination by the inventors, it was found that as the content of the surfactant increases, the number of minute air bubbles might increase after a sucking operation is performed. Therefore, in a case where the discharge amounts of the inks to one unit region are substantially equal and the strengths of the flow of the inks are substantially equal, the number of air bubbles carried by the flows of the inks and reaching the vicinity of discharge ports may increase because the number of formed minute air bubbles increases as the content of the surfactant or the density of the surfactant in ink increases. Based on this mechanism, it may be considered that a defective discharge may be caused easily by an ink sucking operation as the density of the surfactant in the ink increases.

Shapes of Channels

As illustrated in FIGS. 3A and 3B, FIGS. 7A to 7C, and FIG. 8, channels within the print head 3*a* according to this embodiment includes a channel 513*c* for magenta ink being substantially straight and a channel 512*c* for cyan ink and a channel 514*c* for yellow ink both being relatively bending.

According to the examinations by the inventors, it is found that when a bent part is formed within a channel, minute air bubbles may remain in the bent part even though an ink flow occurs. On the other hand, in a case where a channel is formed to be straight, the minute air bubbles may be carried by an ink flow easily, which allows the minute air bubbles to reach the vicinity of discharge ports easily.

Figure 14:
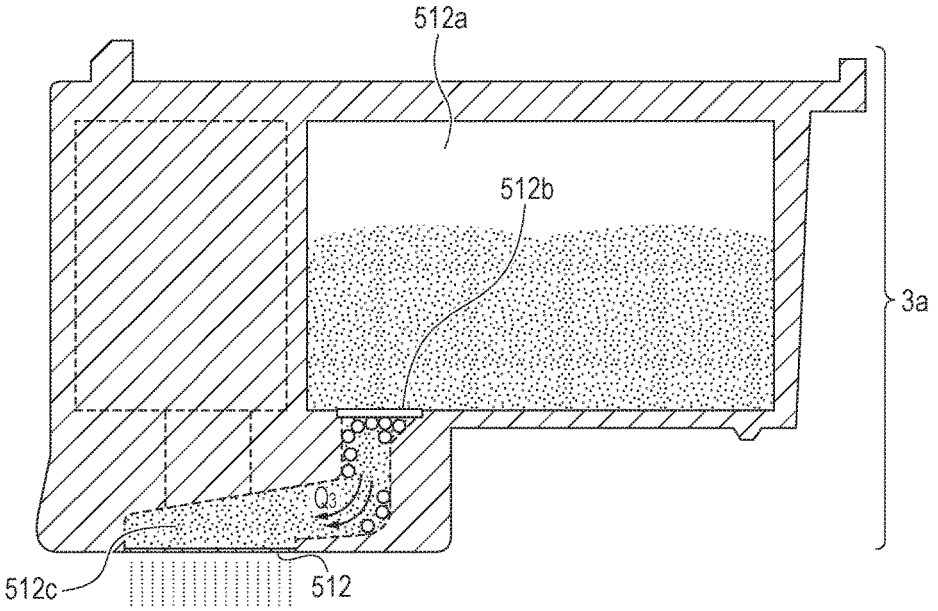
FIG. 14 is a transparent view of a print head according to an embodiment.

FIG. 14 is a transparent view illustrating an internal state of a print head when an operation for discharging cyan ink with a higher discharge amount is performed immediately after a sucking operation is performed, and air bubbles are thus formed. The illustrated state is acquired by performing an operation for discharging cyan ink with a discharge amount substantially equal to a discharge amount for an operation for discharging magenta ink as illustrated in FIG. 7B. Thus, an ink flow Q3 occurs which has an substantially equal strength to that of the ink flow Q1 illustrated in FIG. 7B.

However, in a case where the channel 512*c* is bending as illustrated in FIG. 14, minute air bubbles may stay in the bent part within the channel 512*c* and may not reach the vicinity of discharge ports easily. Thus, a defective discharge may not possibly occur due to a sucking operation through the bent channel even with a strength of ink flow substantially equal to that in the channel 513*c* having a straight shape as illustrated in FIG. 7B.

In view of this matter, according to this embodiment, the threshold discharge amount D_ThM corresponding to magenta ink is defined lower than the threshold discharge amount D_ThC corresponding to cyan ink and the threshold discharge amount D_ThY corresponding to yellow ink. This is because minute air bubbles if formed may reach the vicinity of discharge ports easily through the straight channel 513*c* for magenta ink, unlike the channel 512*c* for cyan ink and the channel 514*c* for yellow ink.

According to this embodiment, the threshold discharge amount D_ThY corresponding to yellow ink is defined slightly lower than the threshold discharge amount D_ThC corresponding to cyan ink. This is because, though the shapes of the yellow ink channel 514*c* and the cyan ink channel 512*c* have substantially similar shapes, the density of the surfactant in yellow ink is higher than that in cyan ink and slightly more minute air bubbles may possibly occur.

More specifically, this embodiment defines the threshold discharge amount D_ThM for magenta ink to 50%, the threshold discharge amount D_ThY for yellow ink to 80%, and the threshold discharge amount D_ThC for cyan ink to 90%.

Apparently, the threshold discharge amount D_ThM (50%) for magenta ink is lower than the threshold discharge amount D_ThY (80%) for yellow ink and the threshold discharge amount D_ThC (90%) for cyan ink. The difference (10%) between the threshold discharge amount D_ThY (80%) for yellow ink and the threshold discharge amount D_ThC (90%) for cyan ink is smaller than the difference (30%) between the threshold discharge amount D_ThM (50%) for magenta ink and the threshold discharge amount D_ThY (80%) for yellow ink. From this, it is found that the threshold discharge amount D_ThY (80%) for yellow ink is slightly lower than the threshold discharge amount D_ThC (90%) for cyan ink.

By defining the threshold discharge amounts D_Th for inks of colors as described above, a defective discharge due to a sucking operation occurring to an extent which varies in accordance with the density of the surfactant in the inks and the shapes of the channels, can be suppressed effectively.

Fourth Embodiment

According to the first to third embodiments, the number of scanning operations to be performed on a unit region is differentiated between the first and second print modes.

According to a fourth embodiment on the other hand, the scanning speed of the print head is differentiated between the first and second print modes.

Any repetitive description regarding the parts similar to those of the first to third embodiments will be omitted.

According to the first to third embodiments, the ink flow rate per unit time period may be controlled to suppress ink defective discharges due to formed minute air bubbles. More specifically, in a case where it is expected that a defective discharge due to minute air bubbles may not occur easily, a print mode with a higher ink flow rate per unit time period is performed to reduce the printing time. In a case where it is concerned that a defective discharge due to minute air bubbles may occur, a print mode with a lower ink flow rate per unit time period is performed to suppress occurrence of a defective discharge.

Here, according to the first to third embodiments, the number of scanning operations to be performed on a unit region on a printing medium is increased to reduce the ink flow rate per unit time period while the number of scanning operations to be performed on a unit region is reduced to increase the ink flow rate per unit time period.

However, other methods may be applicable to control the ink flow rate per unit time period. For example, the ink flow rate per unit time period may be changed by changing the speed (scanning speed) for causing the printing unit 103 to scan.

More specifically, with a lower scanning speed, the printing unit 103 scans a narrower region per unit time period than that with a higher scanning speed, resulting in a lower ink discharge amount per a unit time period, even though an equal ink discharge amount is defined in the print data. In other words, the ink flow rate per unit time period can be reduced.

In view of this matter, according to this embodiment, the first print mode is defined as a print mode with a higher scanning speed of the printing unit 103, and the second print mode is defined as a print mode with a lower scanning speed of the printing unit 103.

According to this embodiment, when an ink defective discharge is not easily caused by minute air bubbles, the first print mode is selected to print at a higher scanning speed. Thus, the ink flow rate per unit time period can be increased, whereby printing can be performed in a shorter printing time.

When there is a concern that minute air bubbles may cause an ink defective discharge, the second print mode is selected to perform printing at a lower scanning speed. Therefore, with a reduced ink flow rate per unit time period, printing can be performed while preventing occurrence of ink defective discharges due to minute air bubbles.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Having described that, according to the aforementioned embodiments, a print mode is changed in accordance with a time passed from a second sucking operation with a higher negative pressure as between a first sucking operation with a lower negative pressure and the second sucking operation, other embodiments can also be implemented. For example, the print mode may be changed further in accordance with the time period passed from a time when the first sucking operation is performed. In this case, because minute air bubbles may more easily occur after a suction with a higher negative pressure is performed, the resulting effect can be larger when the control according to the present invention is applied when the second sucking operation is performed.

According to the aforementioned embodiments, a print head having ink storage chambers and a printing unit integrated thereon is described in which ink tanks provided externally to the print head and the ink storage chambers in the print head are connected to each other using tubes. Based on the above described features, other embodiments can also be implemented. For example, various embodiments of present invention may be applicable to an embodiment in which no ink tank is provided and the print head itself is replaced after ink prestored in the ink storage chamber within the print head is used up. In this case, when ink storage chambers within the print head and ink tanks provided externally to the print head are used, the ink storage chambers and the ink tanks must be connected to each other using a longer tube. For such a configuration, in order to send ink to the ink storage chambers, suction with a higher negative pressure is necessary. Therefore, the importance of the control according to the present invention can be even larger because minute air bubbles can occur more easily after a sucking operation using higher negative pressure is performed.

Having described that, according to the first to third embodiment, a print mode in which an image is completed on a unit region by one scanning operation is defined as a first print mode and a print mode in which an image is completed on a unit region by two scanning operations is defined as a second print mode, other embodiments can be implemented. In the second print mode, a plurality of scanning operations may be performed with an ink flow rate preventing a defective discharge caused by minute air bubbles. In the first print mode, one scanning operation is not necessarily required to be performed on a unit region, but a plurality of scanning operations may be performed for printing. The number of scanning operations in the first print mode and the second print mode may be changed properly in accordance with the type of ink, desired image quality, and the printing speed. However, the number of scanning operations on a unit region in the second print mode is at least required to be higher than the number of scanning operations on the unit region in the first print mode. For example, a print mode in which two scanning operations are performed to complete an image on a unit region may be defined as the first print mode, and a print mode in which eight scanning operations are performed to complete an image on the unit region may be defined as the second print mode.

Having described that, in the second print mode according to the first to third embodiments, all discharge ports corresponding to a unit region are used but the number of discharges per one discharge port can be restricted by thinning out print data, other embodiments can be implemented. For example, a discharge port array may be divided into discharge port groups each including a plurality of discharge ports that are serial in a Y direction and only one discharge port group may discharge ink in one scanning operation. When a plurality of scanning operations complete, each of the discharge port groups discharge ink once. Also in this embodiment, the effect of the first to third embodiments can be acquired because the number of discharges per scanning operation can be restricted. The second print mode may be a print mode in which conveyance of a printing medium is performed between scanning operations.

Having described that, according to the aforementioned embodiments, a timer is used to measure a time period passed from a time point when a sucking operation completes to acquire the time period from the ink sucking operation is performed, other embodiments are also applicable in the present invention. For example, because the time period passed from a time point when a sucking operation starts, which is measured by a timer, is equal to the time period passed from the time point when the sucking operation completes, the effect according to the embodiments can be sufficiently acquired. The threshold time T_Th may be differentiated in accordance with the time point from which the elapsed time is acquired. In addition, use of a timer for measuring the time period is not required. For example, the time point (or time) when the sucking operation completes may be prestored in the ROM 602, and the time period elapsed from the time point when the sucking operation completes can be acquired by calculating a difference between the current time point (time) when printing is performed on a unit region and the time point (time) stored in the ROM 602.

The effect of various embodiments of the present invention acquired by implementing the fourth embodiment can also be acquired in an embodiment a plurality of print heads corresponding to inks and having a length corresponding to the whole area in a width direction of a printing medium are used to print an image by performing one relative scanning operation with the print heads and the printing medium. In this case, the relative scanning operation is performed with the print heads fixed by conveying the printing medium. Thus, changing the conveyance speed for a printing medium corresponds to changing the scanning speed of the print heads according to the fourth embodiment.

Having described the printing method using the printing apparatus according to the aforementioned embodiments, an image processing apparatus an image processing method, or a program for generating data for implementing the printing method according to the aforementioned embodiments may be provided separately from the printing apparatus. Alternatively, embodiments of the present invention are widely applicable to configurations in which they are partially included in a printing apparatus.

The printing apparatus according to the present invention can perform printing while preventing ink defective discharges caused by an ink sucking operation without unnecessarily increasing the printing time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214963, filed Oct. 30, 2015, which is hereby incorporated by reference herein in its entirety.

What is claimed is:

1. A printing apparatus comprising:

a print unit configured to print an image on a plurality of unit regions on a printing medium by ejecting ink from a print head, the print head having a discharge port array in which a plurality of discharge ports configured to discharge ink are aligned in a predetermined direction, wherein, during the printing, the print head moves relative to the printing medium in a cross direction intersecting the predetermined direction;

a suction unit configured to suck ink to the discharge ports within the print head; and a control unit configured to control a printing operation on each of the plurality of unit regions, wherein the control unit controls to (i) perform printing to form an image on a print medium in a first print mode in a case where a time period from a time when the suction unit performs an ink sucking operation is higher than a first threshold value and (ii) perform printing to form an image on a print medium in a second print mode in a case where the time period from a time when the suction unit performs an ink sucking operation is lower than the first threshold value, an ink discharge amount for forming the image on the print medium per unit time period in the second print mode being smaller than an ink discharge amount for forming the image on the print medium per unit time period in the first print mode.

2. The printing apparatus according to claim 1, wherein the first print mode is a print mode in which the print head scans the unit region at a first speed for printing; and wherein the second print mode is a print mode in which the print head scans the unit region at a second speed that is lower than the first speed for printing.

3. The printing apparatus according to claim 1, wherein the control unit controls to (i) perform printing in the first print mode in a case where a time period from a time when the suction unit performs an ink sucking operation is higher than the first threshold value, (ii) perform printing in the first print mode in a case where the time period from a time when the suction unit performs the ink sucking operation is lower than the first threshold value, and an ink discharge amount to the unit region is lower than a second threshold value, and (iii) perform printing in the second print mode in a case where the time period from the time when the suction unit performs the ink sucking operation is lower than the first threshold value, and the ink discharge amount to the unit region is higher than the second threshold value.

4. The printing apparatus according to claim 1, wherein a length in the predetermined direction of each of the plurality of unit regions is substantially equal to a length of the discharge port array in the predetermined direction.

5. The printing apparatus according to claim 1, wherein the first print mode is a print mode in which the print head scans the unit region a first number of times for printing; and wherein the second print mode is a print mode in which the print head scans the unit region a second number of times higher than the first number of times for printing.

6. The printing apparatus according to claim 5, wherein the first print mode is a print mode in which the print head scans the unit region once.

7. The printing apparatus according to claim 5, further comprising a conveying unit configured to convey the print head relative to the printing medium in a conveying direction intersecting the cross direction after printing on the unit region in one print mode of the plurality of print modes, wherein the second print mode is a print mode in which the print head is scanned the second number of times on the unit region without conveying by the conveying unit.

8. The printing apparatus according to claim 1, wherein the print head has a first discharge port array configured to discharge a first type of ink and a second discharge port array configured to discharge a second type of ink that is different from the first type; and wherein the control unit controls to (i) perform printing in the first print mode in a case where a time period from a time when the suction unit performs an ink sucking operation is higher than the first threshold value, (ii) perform printing in the first print mode in a case where the time period from a time when the suction unit performs the ink sucking operation is lower than the first threshold value, a discharge amount of the first type of ink to the unit region is lower than a second threshold value, and a discharge amount of the second type of ink to the unit region is lower than a third threshold value, (iii) perform printing in the second print mode in a case where the time period from the time when the suction unit performs the ink sucking operation is lower than the first threshold value, the discharge amount of the first type of ink to the unit region is higher than the second threshold value, and the discharge amount of the second type of ink to the unit region is higher than the third threshold value, (iv) perform printing in the second print mode in a case where the time period from the time when the suction unit performs the ink sucking operation is lower than the first threshold value, where the discharge amount of the first type of ink to the unit region is lower than the second threshold value, and where the discharge amount of the second type of ink to the unit region is higher than the third threshold value, and (v) perform printing in the second print mode in a case where the time period from the time when the suction unit performs the ink sucking operation is lower than the first threshold value, the discharge amount of the first type of ink to the unit region is higher than the second threshold value, and the discharge amount of the second type of ink to the unit region is lower than the third threshold value.

9. The printing apparatus according to claim 8, wherein the third threshold value is lower than the second threshold value.

10. The printing apparatus according to claim 9, wherein the first type of ink contains a predetermined surfactant in a first density, and the second type of ink contains the predetermined surfactant in a second density that is higher than the first density.

11. The printing apparatus according to claim 9, wherein the print head further has a first channel configured to connect the plurality of discharge ports within the first discharge port array to a first storage chamber configured to store the first type of ink and a second channel configured to connect the plurality of discharge ports within the second discharge port array to a second storage chamber configured to store the second type of ink; and wherein the first channel bends more than the second channel.

12. The printing apparatus according to claim 11, wherein the print head further has the first storage chamber and the second storage chamber.

13. The printing apparatus according to claim 1, further comprising:

an acquiring unit configured to acquire information regarding a time period from a time when the suction unit performs an ink sucking operation; and a selecting unit configured to select one print mode for each unit region from a plurality of print modes including at least the first print mode and the second print mode, wherein the selecting unit (i) selects the first print mode in a case where a time period described in the information acquired by the acquiring unit is higher than the first threshold value, and (ii) selects the second print mode in a case where the time period described in the information acquired by the acquiring unit is lower than the first threshold value; and wherein the control unit controls a printing operation for each of the plurality of unit regions in accordance with the print mode selected for each of the unit regions by the selecting unit.

14. The printing apparatus according to claim 13, wherein the suction unit at least performs a first sucking operation for sucking ink at a first suction pressure and a second sucking operation for sucking ink at a second suction pressure that is higher than the first suction pressure; and wherein the acquiring unit acquires information regarding a time period from a time when the second sucking operation of the first and second sucking operations is performed, as the information regarding the time period from a time when the suction unit performs the ink sucking operation.

15. The printing apparatus according to claim 14, wherein the suction unit performs the second sucking operation when the printing apparatus is first used after the print head is mounted on the printing apparatus.

16. The printing apparatus according to claim 14, further comprising an ink tank configured to store ink and which is at outside of the print head and connected to the print head, wherein the suction unit performs the second sucking operation in a case where the remaining amount of ink within the ink tank is smaller than a predetermined amount, and where the printing apparatus is first used after ink is filled in the ink tank.

17. The printing apparatus according to claim 16, wherein an operation for filling ink in the ink tank can be executed by a user.

18. A printing apparatus for printing an image on a plurality of unit regions on a printing medium by ejecting ink from a print head, the print head having a discharge port array in which a plurality of discharge ports configured to discharge ink are aligned in a predetermined direction, wherein the print head is moved relative to the printing medium in a cross direction intersecting the predetermined direction, the printing apparatus comprising:

a suction unit configured to suck ink to the discharge ports within the print head; and a control unit configured to control a printing operation on each of the plurality of unit regions, wherein the control unit controls to (i) perform printing in a first print mode in which the print head is scanned a first number of times on the unit region, in a case where a time period from a time when the suction unit performs an ink sucking operation is higher than a first threshold value and (ii) perform printing in a second print mode in which the print head is scanned a second number of times that is higher than the first number of times on the unit region and the number of discharges per one scanning operation of the print head is restricted, in a case where the time period from a time when the suction unit performs an ink sucking operation is lower than the first threshold value.

19. A printing method comprising:

printing an image on a plurality of unit regions on a printing medium by ejecting ink from a print head, the print head having a discharge port array in which a plurality of discharge ports configured to discharge ink are aligned in a predetermined direction, wherein, during the printing, the print head moves relative to the printing medium in a cross direction intersecting the predetermined direction;

sucking ink to the discharge ports within the print head; and controlling a printing operation on each of the plurality of unit regions, wherein the controlling controls to (i) perform printing to form an image on a print medium in a first print mode in a case where a time period from a time when the sucking performs an ink sucking operation is higher than a first threshold value and (ii) perform printing to form an image on a print medium in a second print mode in a case where the time period from a time when the sucking performs an ink sucking operation is lower than the first threshold value, an ink discharge amount for forming the image on the print medium per unit time period in the second print mode being smaller than an ink discharge amount for forming the image on the print medium per unit time period in the first print mode.

20. A printing apparatus comprising:

a printing unit configured to print an image on a plurality of unit regions on a printing medium by ejecting ink from a print head, the print head having a discharge port array in which a plurality of discharge ports configured to discharge ink are aligned in a predetermined direction and further has a first channel configured to connect the plurality of discharge ports within the first discharge port array to a storage chamber configured to store the ink, wherein, during the printing, the print head moves relative to the printing medium in a cross direction intersecting the predetermined direction;

an ink tank configured to store ink to be supplied to the first storage chamber and which is at outside of the print head and connected to the print head;

a suction unit configured to suck ink to the discharge ports within the print head in a case where the remaining amount of ink within the ink tank is smaller than a predetermined amount, and where the printing apparatus is first used after ink is filled in the ink tank; and a control unit configured to control a printing operation on each of the plurality of unit regions, wherein the control unit controls to (i) perform printing to form an image on a print medium in a first print mode in a case where a time period from a time when the suction unit performs an ink sucking operation is higher than a first threshold value and (ii) perform printing to form an image on a print medium in a second print mode in a case where the time period from a time when the suction unit performs an ink sucking operation is lower than the first threshold value, an ink discharge amount for forming the image on the print medium per unit time period in the second print mode being smaller than an ink discharge amount for forming the image on the print medium per unit time period in the first print mode.

* * * * *